US005312667A

United States Patent [19]

Lumb et al.

[11] Patent Number: 5,312,667

[45] Date of Patent: May 17, 1994

[54] COMPOSITE SWEATSHIRT FABRIC

[75] Inventors: Douglas Lumb, Methuen; Moshe Rock, Andover, both of Mass.

[73] Assignee: Malden Mills Industries, Inc., Lawrence, Mass.

[21] Appl. No.: 704,781

[22] Filed: May 23, 1991

[51] Int. Cl.[5] ..... B32B 33/00; D06C 11/00

[52] U.S. Cl. ..... 428/91; 428/95; 428/96; 428/97; 428/245; 428/252; 428/253; 428/254; 428/290; 428/297

[58] Field of Search ..... 428/253, 245, 252, 254, 428/297, 290, 91, 95, 96, 97

[56] References Cited

U.S. PATENT DOCUMENTS

| | | | |
|---|---|---|---|
| 3,959,054 | 5/1976 | Pietsch et al. | 156/148 |
| 4,136,218 | 1/1979 | Nischwitz et al. | 427/339 |
| 4,241,124 | 12/1980 | Kremer et al. | 428/156 |
| 4,264,645 | 4/1981 | von Bonin et al. | 427/55 |
| 4,530,873 | 7/1985 | Okada | 428/253 |
| 4,533,594 | 8/1985 | Buchanan | 428/236 |
| 4,621,489 | 11/1986 | Okada | 57/210 |
| 4,704,112 | 11/1987 | Suzuki et al. | 604/378 |
| 4,735,849 | 4/1988 | Murakami et al. | 428/224 |
| 4,883,052 | 11/1989 | Weiss et al. | 128/205.27 |
| 5,065,600 | 11/1991 | Byles . | |

FOREIGN PATENT DOCUMENTS 63297516 6/1990 Japan .

*Primary Examiner*—George F. Lesmes
*Assistant Examiner*—Terrel Morris
*Attorney, Agent, or Firm*—Gottlieb, Rackman & Reisman

[57] ABSTRACT

A composite textile fabric for moving moisture away from the skin is provided. The composite fabric includes a first fabric layer comprising either a polyester or nylon material which has been rendered hydrophilic and a second fabric layer comprising at least 25% by weight of a moisture absorbent material such as cotton. The first fabric layer and the second fabric layer are formed concurrently by knitting a plaited construction. Preferably, the second fabric layer is treated with a polyurethane to promote resistance to pilling.

14 Claims, 1 Drawing Sheet

COMPOSITE SWEATSHIRT FABRIC

BACKGROUND OF THE INVENTION

This invention relates to a composite textile fabric, and more particularly to a composite fabric made of either a polyester or nylon material whose surface has been raised and a moisture absorbent material such as cotton which together act to move moisture away from the skin and through a garment made with the composite fabric.

Most textile fabric for outerwear is likely to result in the substantial enclosure of moisture between the wearer's skin and undergarments or between the undergarments of the wearer and the outerwear. When saturation of moisture takes place, accumulated moisture condenses and the body of the garment wearer is wetted such that he begins to feel uncomfortable.

Although it is possible to use a cotton inner lining for a textile fabric that is suitable for outer garments, such as sweatshirt garments used for athletics and exercise, the preferred inner lining presently used today due to its wearability, warmth and loft retention is that made of a polyester material. However, garments, including sportswear, having an inner polyester lining fail to have sufficient moisture transport characteristics if the wearer of the garment exercises for an extended time period.

Accordingly, it would be desirable to provide a textile fabric which overcomes the above disadvantages, and which helps transport water away from the skin or undergarment of the wearer.

SUMMARY OF THE INVENTION

Generally speaking, in accordance with the invention, a composite textile fabric for moving moisture away from the skin is provided. The composite fabric includes a first fabric layer comprising either a polyester or nylon material whose surface has been raised and which has been rendered hydrophilic, and a second fabric layer comprising at least 35% by weight of a moisture absorbent material (such as cotton). The first fabric layer and the second fabric layer are formed concurrently by knitting a plaited construction so that the layers are distinct and separate yet integrated one with the other. Preferably, the second fabric layer is treated with a polyurethane to promote resistance to pilling.

In application, the composite textile fabric of the invention is used in a variety of garments, including sweatshirts, sweat pants, underwear, bathrobes, and various types of exercise clothing. The first fabric layer whose surface has been raised is worn against the skin or undergarment of the wearer. Because the polyester or nylon material of the first fabric layer is hydrophilic, moisture from the skin is quickly transported through the first layer and is then absorbed by the second layer of the composite fabric. The moisture absorbed in the second fabric layer is then evaporated from the outside of the garment (the surface of the second fabric layer).

Of significance is the fact the fabric construction is plaited. This feature helps to create a substantial moisture concentration gradient between the surface of the raised polyester or nylon layer (which quickly transports water from the skin) and the cotton layer (which absorbs the water from the first layer and from which the water is evaporated).

Accordingly, it is an object of the invention to provide an improved composite textile fabric for enhancing the transport of moisture away from the skin.

It is also an object of the invention to provide an improved composite textile fabric having a plurality of polyester or nylon fibers for conducting liquid moisture.

Another object of the invention is to provide an improved composite textile fabric which includes plaited layers for promoting the moisture concentration gradient between the two layers.

A further object of the invention is to provide a composite textile fabric which includes an outer moisture absorbent layer.

Still another object of the invention is to provide a composite textile fabric which has a non-pilling outer layer.

Yet a further object of the invention is to provide a composite textile fabric which includes an inner layer for promoting warmth.

Still other objects and advantages of the invention will in part be obvious and will in part be apparent from the following description.

The invention accordingly comprises the several steps and relation of one or more of the steps with respect to each of the others, and the material or materials having the features, properties, and relation of constituents which are exemplified in the following detailed disclosure, and the scope of the invention will be indicated in the claims.

BRIEF DESCRIPTION OF THE DRAWINGS

Reference is made to the following description, taken in connection with the accompanying drawing in which.

DETAILED DESCRIPTION OF PREFERRED EMBODIMENT

Figure 1:
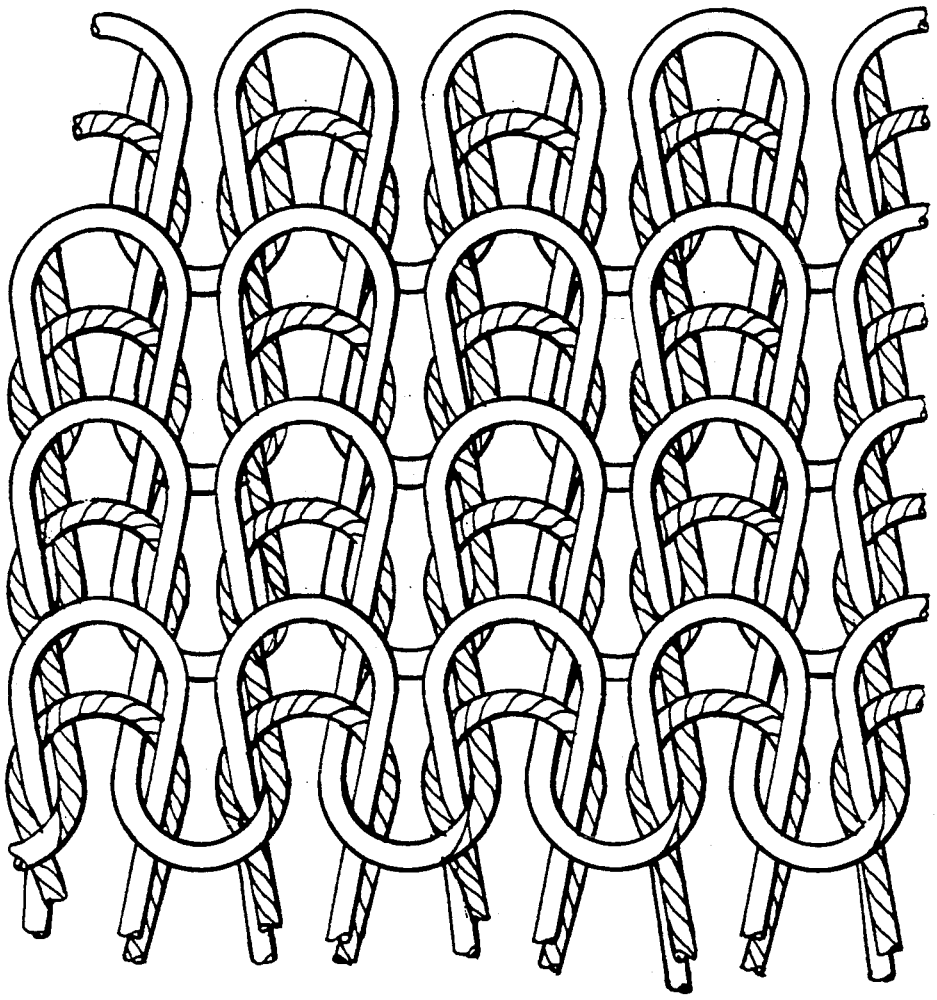
FIG. 1 is a section view of the composite textile fabric having a terry construction.

The composite textile fabric of the invention includes a first fabric layer comprising either a polyester or nylon material whose surface has been raised and which has been rendered hydrophilic and a second fabric layer comprising at least 35% by weight of a moisture absorbent material. The first fabric layer and the second fabric layer are formed concurrently by knitting a plaited construction so that the layers are distinct and separate yet integrated one with the other.

The first fabric layer comprises between about 40 and 70% by weight of the fabric. The second fabric layer comprises between about 30 and 60% by weight of the fabric. The amount of each fabric layer is selected based on the desired weight of the composite fabric, the end use desired of the composite fabric and the requirements for transferring moisture from the polyester or nylon fleece layer to the moisture absorbent layer. The weight per unit area of the composite fabric is between about 2.5 ounces/yards$^2$ and 15 ounces/yard$^2$, depending upon the end use requirements for thermal protection and moisture control.

In accordance with the invention, the construction of the composite fabric is such that it has a plaited effect—although each fabric layer is distinct and separate, each is integrated with the other. As a result, the composite fabric functions as a single unit.

The composite fabric may be constructed as a warp or weft knit, such as a two-end fleece, three-end fleece, terry with regular plaiting, double terry, double needle raschel and tricot.

The second layer, as stated above, must include at least 35% by weight of a moisture absorbent material. Preferably, the second layer should include at least 50% by weight of a moisture absorbent material. The preferred moisture absorbent material is cotton, since it can absorb 2–3 times its weight of water. The yarn used for the second layer is typically spun from either combed or carded cotton. Other suitable moisture absorbent materials include rayon and wool as well as other natural fibers and synthetics such as Hydrofil, manufactured by Allied Signal Inc. (described hereinafter in further detail) so long as the moisture absorbency of the material chosen for the second layer is greater than that of the material chosen for the first layer.

In a preferred embodiment, the second fabric layer includes cotton as the major constituent (at least 25% by weight) and other moisture absorbent materials such as rayon and wool as minor constituents (with the total amount of moisture absorbent material comprising at least 50% by weight.)

The surface of the first fabric layer is raised. The raised surface includes a plurality of polyester or nylon fibers for conducting liquid water therealong from the wearer's skin to the moisture absorbent layer. A polyester or nylon material is chosen because it retains its loft/bulk, thereby maintaining its aesthetic appeal and functionality (warmth) after repeated washings.

Significantly, the surface of the first layer is raised by a conventional process such as napping. Thus, the first layer comprises a pile fabric, with each fiber end being a conductor of moisture.

The polyester or nylon layer is either round or modified cross-section, 0.3 to 6.0 denier, and either spun or filament. The layer is chemically treated or utilizes modified fiber so that it is rendered hydrophilic, as described hereinbelow.

After constructing the composite fabric of the invention, the fabric is dyed. More particularly, the second fabric layer is dyed utilizing dyes selected from reactive dyestuffs, direct dyestuffs, vat dyestuffs and sulphur dyestuffs.

Suitable reactive dyestuffs include Procion manufactured by I.C.I. of Wilmington, Del., Basilan manufactured by BASF of Charlotte, N.C., Remazol manufactured by Hoechst of Coventry, R.I., and Levafix manufactured by Mobay of Pittsburgh, Pa.

Suitable direct dyestuffs include Solophenyl manufactured by Ciba-Geigy of Greensboro, N.C., Sirius manufactured by Mobay, and Intralite manufactured by Crompton and Knowles of Rumford, R.I.

Suitable vat dyestuffs include Indanthren manufactured by Mobay, Palanthrene manufactured by BASF, Sandothrene manufactured by Sandoz of Fair Lawn, N.J., and Intravat manufactured by Crompton and Knowles.

If the first fabric layer is polyester, the first fabric layer is dyed by applying standard disperse dyestuffs. Suitable disperse dyestuffs include Dispersol manufactured by I.C.I., Sammaron manufactured by Hoechst, and Resolin manufactured by Mobay.

In order to render the polyester layer hydrophilic, a low molecular weight polyester is added to the dye bath. The low molecular weight polyester is chosen from Milease T manufactured by I.C.I., Scotchrelease FC-226 manufactured by the 3-M Company of Minneapolis, Minn., Zelcon manufactured by DuPont of Wilmington, Del., and Avconav S.R. manufactured by AVCO of Tel Aviv, Israel.

The amount of the low molecular weight polyester added is between about 1.75 and 2.75 weight percent based on the weight of the composite fabric. The preferred amount is 2.25 weight percent based on the weight of the composite fabric.

When the dye bath containing the low molecular weight polyester is applied to the polyester layer, it is applied at an elevated temperature of between 250° Fahrenheit and 275° Fahrenheit, with the preferred temperature being approximately 265° Fahrenheit.

If instead the first fabric layer is nylon, the first fabric layer is dyed in an acid medium at a temperature between 205° F. and 220° F. Suitable dyes which may be used include acid dyes including Telon metal complex dyes such as Isolan, manufactured by Mobay, and metal complex dyes such as Palatin, manufactured by BASF.

In order to render the nylon layer hydrophilic, a low molecular weight polyester is added to the dye bath. Suitable low molecular weight polyesters include Scotchrelease FC-248 manufactured by 3-M and Milease T manufactured by I.C.I. Addition of the low molecular weight polyester to the dye bath is the same as to the dye bath used for the polyester layer.

Alternatively, a chemically modified nylon such as Hydrofil, a Nylon 6 copolymer manufactured by Allied Signal Inc. of Petersburg, Va., which is hydrophilic and does not require any chemical treatment, may be used.

By using a chemically modified fiber or by chemically treating the first fabric layer, the layer is rendered substantially hydrophilic. As a result, the transport of water from the raised surface of the first fabric layer to the moisture absorbent layer is substantially enhanced—liquid moisture is made readily transportable along the surface of each polyester or nylon fiber.

In order to promote the non-pilling characteristics of the moisture absorbent layer, the face of the layer is coated with an aliphatic-polyester polyurethane blend. Unlike some urethanes which interfere with moisture removal ability, the particular blend chosen is one that will not affect the absorbency of the layer. Suitable aliphatic-polyester polyurethane blends include Rezthane, manufactured by C.N.C. of Woonsocket, R.I., Permuthane UE74-325 manufactured by Permuthane Coatings of Peabody, Mass., and Goodrich U-66, manufactured by BF Goodrich of Avon Lake, Ohio.

In order to further illustrate the composite fabric of the invention, the following Example is provided.

EXAMPLE

A composite fabric made in accordance with the invention was knit on a circular knitting machine with a terry construction, 23 wales/inch and 30 courses/inch. The composite fabric had a moisture absorbent layer comprising 90% cotton and 10% rayon, 26/1 ring-spun yarn. The composite fabric also had a polyester layer comprising 100% 2.2 denier polyester, 150 denier textured yarn. The polyester layer comprised 61% by weight, while the moisture absorbent layer comprised 39% by weight. The weight per unit area of the composite fabric was 9.6 ounces/ yards$^2$. As part of manufacture, the moisture absorbent layer was dyed with a reactive dye.

In order to render the polyester layer hydrophilic, Scotchrelease FC-226 was added to a disperse dye bath in the amount of 2.25% by weight based on the weight of the composite fabric, applied to the polyester layer at a temperature of 265° Fahrenheit.

Thereafter, the face of the polyester layer was raised by napping. Then, the face of the moisture absorbent layer was coated with Rezthane in the amount of 4.5% by weight based on the weight of the fabric.

A composite fabric made in accordance with the invention will have the following characteristics after 30 washings conducted according to the AATCC Test Method 135 as follows:

1. Moisture Vapor Transfer—this measures how effectively moisture is passed through the fabric. The ASTM E96 upright cup method is utilized. In connection with the Example, the moisture vapor transfer rate was calculated to be 1,068 grams/meter$^2$/24 hours.

2. Pilling—pilling was evaluated by conducting tests under the ASTM E3512 standard. The fabric is caused to form typical pills by random rubbing motions produced by tumbling fabric specimens in a cylindrical test chamber lined with a mildly abrasive material. On a scale of 1 to 5 worst to best, in connection with the Example, the pilling rating was evaluated to be 4.

A significant aspect of the inventive composite fabric is that there is nothing interposed between the first fabric and moisture absorbent layers. These layers are formed concurrently by knitting a plaited construction so that the layers are distinct and separate yet integrated one to the other. Together the layers act to move moisture away from the skin and through a garment made with the composite fabric by the creation of a moisture concentration gradient (see FIG. 1). Evaporation into the exposed air from the surface of the moisture absorbent layer sets up the gradient which serves as the driving force to move or transport the moisture through the fabric.

It will thus be seen that the objects set forth above, and those made apparent from the preceding description, are efficiently attained, and since certain changes may be made in the product set forth above without departing from the spirit and scope of the invention, it is intended that all matter contained in the above description shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

We claim:

1. A composite textile fabric comprising a first fabric layer of a material selected from the group consisting of polyester and nylon having a raised fiber surface for conducting moisture and which has been rendered hydrophilic and a second fabric layer comprising at least 35% by weight of a moisture absorbent material wherein the first fabric layer and the second fabric layer are formed concurrently by knitting a plaited construction so that there is nothing imposed between the first and second fabric layers.

2. The fabric of claim 1, wherein said second fabric layer is treated with a polyurethane to promote resistance to pilling.

3. The fabric of claim 1, wherein the second fabric layer comprises at least 25% cotton by weight.

4. The fabric of claim 1, wherein said second fabric layer further comprises at least 50% by weight of a moisture absorbent material.

5. The fabric of claim 1, wherein said moisture absorbent material is selected from the group comprising cotton, rayon and wool.

6. The fabric of claim 5, wherein said moisture absorbent material is cotton.

7. The fabric of claim 1, wherein said fabric has a construction selected from the group comprising two-end fleece, three-end fleece, terry with regular plating, double terry, double needle raschel and tricot.

8. The fabric of claim 1, wherein the first fabric layer comprises between about 40 and 70% by weight of the fabric and said second fabric layer comprises between about 30 and 60% by weight of the fabric.

9. The fabric of claim 1, wherein said fabric has a weight per unit area of between about 2.5 ounces/yards$^2$ and 15 ounces/yards$^2$.

10. The fabric of claim 1, wherein each of the fabric layers is treated with a dye after construction.

11. The fabric of claim 1, wherein said first fabric layer material includes a low molecular weight polyester in an amount between about 1.75 and 2.75 weight percent based on the weight of the composite fabric for rendering said material hydrophilic.

12. The fabric of claim 2, wherein the polyurethane is an aliphatic-polyester polyurethane.

13. The fabric of claim 12, wherein said aliphatic polyester polyurethane is coated along said second layer in an amount between about 3.75 and 5.75 weight percent based on the weight of the fabric.

14. The fabric of claim 1, wherein said material is polyester.

* * * * *